US007677490B2

(12) United States Patent
Smallwood

(10) Patent No.: US 7,677,490 B2
(45) Date of Patent: Mar. 16, 2010

(54) APPARATUS AND METHOD FOR UNWINDING ROLLS OF ELONGATED FLEXIBLE MATERIAL, SUCH AS ELECTRICAL WIRE

(76) Inventor: Travis L. Smallwood, W2845 County Road J, Sheboygan Falls, WI (US) 53085

( * ) Notice: Subject to any disclaimer, the term of this patent is extended or adjusted under 35 U.S.C. 154(b) by 141 days.

(21) Appl. No.: 11/945,335

(22) Filed: Nov. 27, 2007

(65) Prior Publication Data

US 2008/0142629 A1 Jun. 19, 2008

Related U.S. Application Data

(60) Provisional application No. 60/875,660, filed on Dec. 19, 2006.

(51) Int. Cl.
*B65H 75/24* (2006.01)

(52) U.S. Cl. ..... 242/578; 242/404.3; 242/577.4

(58) Field of Classification Search ..... 242/577, 242/577.2, 577.3, 577.4, 578, 578.2, 404.3, 242/407.1, 607.1

See application file for complete search history.

(56) References Cited

U.S. PATENT DOCUMENTS

| | | | | | |
|---|---|---|---|---|---|
| 1,068,291 | A * | 7/1913 | Wuebbenherst | ..... | 242/407.1 |
| 1,831,848 | A * | 11/1931 | Doney et al. | ..... | 242/578.2 |
| 1,929,469 | A * | 10/1933 | Ball | ..... | 242/577.2 |
| 2,382,968 | A * | 8/1945 | Berman | ..... | 242/407.1 |
| 2,562,095 | A * | 7/1951 | Hengst | ..... | 242/407.1 |
| 3,017,136 | A * | 1/1962 | Noffke | ..... | 242/129 |
| 3,107,878 | A * | 10/1963 | Wong | ..... | 242/422.4 |
| 3,128,060 | A * | 4/1964 | Lee | ..... | 242/578 |
| 5,649,677 | A * | 7/1997 | Culp | ..... | 242/407.1 |
| 6,352,215 | B1 * | 3/2002 | Cash et al. | ..... | 242/578 |
| 2007/0181731 | A1 * | 8/2007 | Taylor | ..... | 242/407.1 |

* cited by examiner

*Primary Examiner*—William A Rivera
(74) *Attorney, Agent, or Firm*—Andrus, Sceales, Starke & Sawall, LLP

(57) ABSTRACT

A dispenser is adapted to be used in unwinding a roll of elongated flexible material. The dispenser includes a support bracket, a central member rotatably mounted to the support bracket and a plurality of hinged support arm assemblies attached to the central support member and movable between an extended position and a retracted position.

8 Claims, 6 Drawing Sheets

APPARATUS AND METHOD FOR UNWINDING ROLLS OF ELONGATED FLEXIBLE MATERIAL, SUCH AS ELECTRICAL WIRE

CROSS REFERENCE TO RELATED APPLICATION

This application is based on and claims priority from U.S. Provisional Patent Application Ser. No. 60/875,660, filed Dec. 19, 2006.

FIELD OF THE INVENTION

The present invention relates generally to an apparatus and method for holding and dispensing objects, and more particularly, pertains to an extendable and collapsible apparatus and method useful in unwinding a roll of coiled elongated flexible material.

BACKGROUND OF THE INVENTION

In the installation of electrical wire, an electrician manually pulls a length of wire as desired from a spool or coil which normally rests on the ground or other support surface. In the unwinding of wire from the coil, problems arise as the unwound wire becomes spiraled and/or twisted. In some cases, this causes the entire spool to be dragged across the ground. Twisting or spiraling of the wire and movement of the coil are frustrating to the electrician and cause delays and complications in the electrical wiring of the structure.

There remains a need to address the problems experienced in the dispensing of electrical wire, and to maintain the electrical wire manageable for installation.

SUMMARY OF THE INVENTION

It is a general object of the present invention to provide a dispenser and method for more efficiently dispensing a formed roll of elongated flexible material, such as electrical wire, but also including cables, conduits, hoses, ropes, lines, strips and the like.

It is also an object of the present invention to provide a dispenser which can be suspended from a support member.

It is a further object of the present invention to provide a dispenser with an extendable and retractable structure that allows for smooth unwinding of a wire supply and convenient loading of a new wire supply in a suspended position.

It is another object of the present invention to provide a dispenser that rotates about a vertical axis while a wire supply is supported thereon.

It is an additional object of the present invention to provide a dispenser which automatically assumes an extendable, material supporting position due to gravity.

In one aspect of the invention, a dispenser is adapted to be used in unwinding a roll of elongated flexible material. The dispenser includes a support bracket, a central member rotatably mounted to the support bracket and a plurality of hinged support arm assemblies attached to the central member and movable between an extended position and a retracted position.

The support member is a rigid member having a generally C-shaped cross section adapted to be supported from a support member. The central member is an elongated, vertically extending element having a top end rotatably connected to the support bracket by a pin, and a bottom end provided with a series of pivot brackets fixed thereto. Each hinged support arm assembly includes an upper support arm and a lower support arm. The upper support arm has an upper end pivotally attached to a guide collar that is slidably mounted along a periphery of the central member. The upper support arm has a lower end that is pivotally connected to an upper end of the lower support arm. The lower support arm has a lower end pivotally secured to the pivot brackets fixed on the bottom end of the central member.

The invention further contemplates a method of dispensing flexible elongated material from a roll having a central recess, the method comprising the steps of:

(a) providing a dispenser including a rigid support bracket configured with a generally C-shape and formed with an upper hook portion, a vertical wall and a lower wall with an aperture provided therethrough, a rigid, vertically extending central member in the form of an elongated bar with a generally polygonal cross section having flat side walls, a top end rotatably connected to the lower wall of the support bracket by a pivot pin, and a bottom end provided with a series of pivot brackets attached thereto, and a plurality of hinged support arm assemblies attached to the central member and movable between a retracted position and an extended position, each support arm assembly including an upper support arm and a lower support arm, the upper support arm having an upper end pivotally attached to a guide collar that is slidably mounted about a periphery of the central member, and a lower end that is pivotally connected to an upper end of the lower support arm, the lower support arm having a lower end pivotally secured to the pivot brackets fixed on the bottom end of the central member, the hinged support arm assemblies buckling outwardly relative to the central member into an extended, material-supporting position;

(b) placing the recess of the roll of flexible material over the central member and the support bracket so that the roll of flexible material is supported on upper portions of the extended upper support arms;

(c) suspending the support bracket from a fixed support member; and (d) pulling an end of the roll of flexible material so that the roll rotates with the hinged support arm assemblies and the central member relative to the fixed support member to unwind the flexible material from the roll.

When the roll of flexible material has been exhausted, a new roll of flexible material is placed at the bottom of the dispenser and moved upwardly causing the upper and lower support arms to retract until the new roll passes beyond pivot points between the upper and lower support arms after which the upper and lower support arms extend so that the new roll is supported by the upper portions of the extended upper arms.

Various other objects, features and advantages of the invention will be made apparent from the following description taken together with the drawings.

BRIEF DESCRIPTION OF THE DRAWINGS

The drawings illustrate the best mode presently contemplated of carrying out the invention. In the drawings.

DETAILED DESCRIPTION

Figure 1:
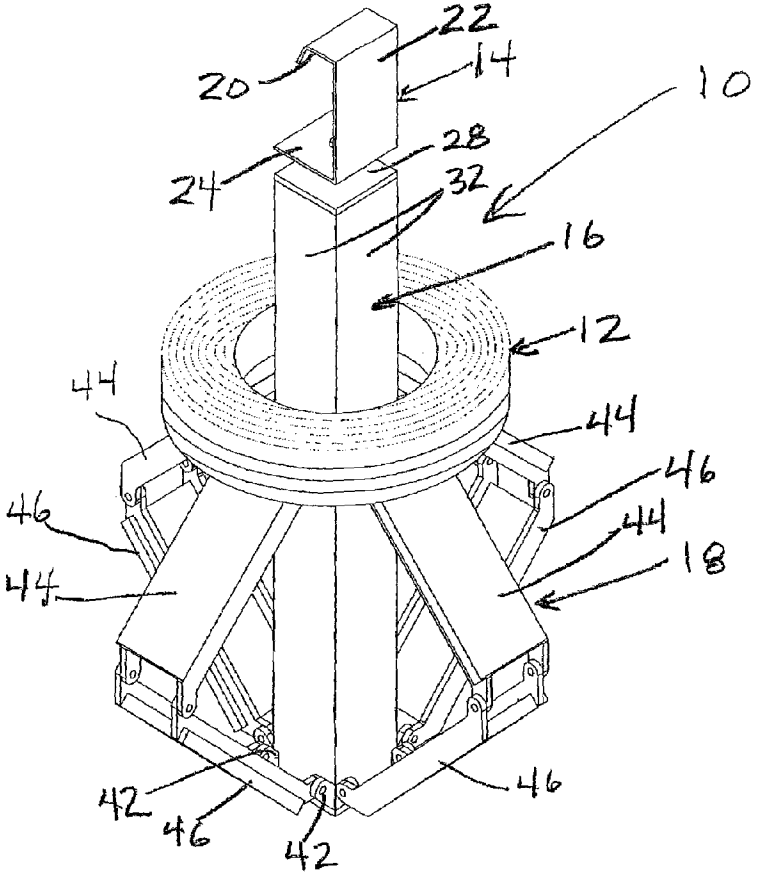
FIG. 1 is a top perspective view of an apparatus for dispensing a roll of elongated flexible material, the apparatus being shown in an extended, material supporting position.

Referring now to the drawings, thereshown is an apparatus or dispenser 10 for use in manually unwinding a roll of elongated flexible material 12 in an efficient, manageable fashion.

In the preferred embodiment, it is envisioned that the elongated flexible material 12 is electrical wire as used by an electrician in the electrical wiring of a building. However, it should be understood that the dispensing apparatus 10 can be used to unwind or unreel many different types of elongated flexible material including but not limited to cables, conduits, hoses, ropes, strips, lines, etc. that can be wound or coiled in roll form and dispensed therefrom.

The dispenser 10 is generally comprised of a support bracket 14, a central member 16 and a plurality of hinged support arm assemblies 18.

Figure 2:
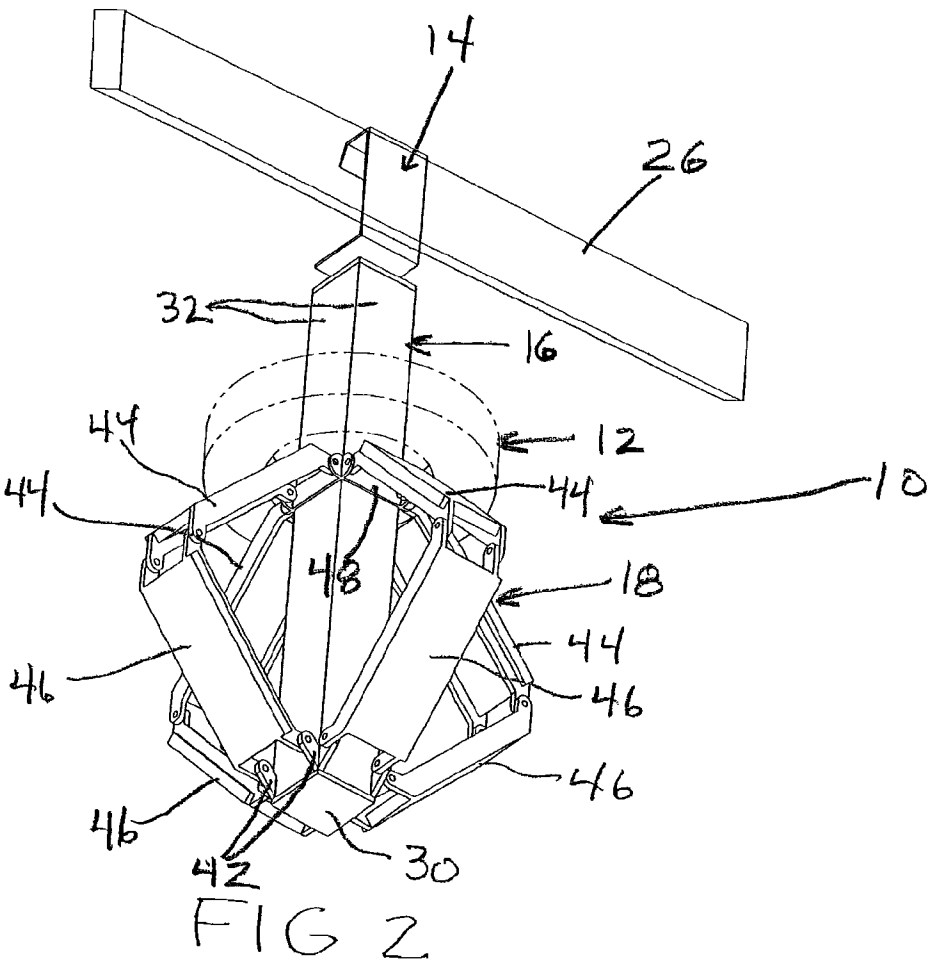
FIG. 2 is a bottom perspective view of FIG. 1.

Support bracket 14 is a rigid member which is preferably constructed from galvanized steel or any other suitable metallic material. The support bracket 14 is configured with a generally C-shaped cross section having an upper hook portion 20, a vertical wall 22 and a lower horizontal wall 24 formed with an aperture therethrough. The support bracket 14 is adapted to be engaged with a support member 26 as shown in FIG. 2. The support member 26 can take the form of an unfinished ceiling truss, a floor joist or an unfinished doorway for example. Although not specifically illustrated, the vertical wall 22 of the support bracket 14 may be provided with a recess for suspending the dispenser 10 when not in use.

Central member 16 is a rigid, vertically extending element which is preferably constructed from a plastic or other suitable material. In the preferred embodiment, the central member 16 is provided in the form of an elongated bar having a generally square cross section with a flat top end 28, a flat bottom end 30 and four flat sidewalls 32 defining a periphery for supporting the support arm assemblies 18. It should be understood, however, that the central member 16 may have other cross sections and configurations other than square for supporting the support arm assemblies 18.

Figure 5:
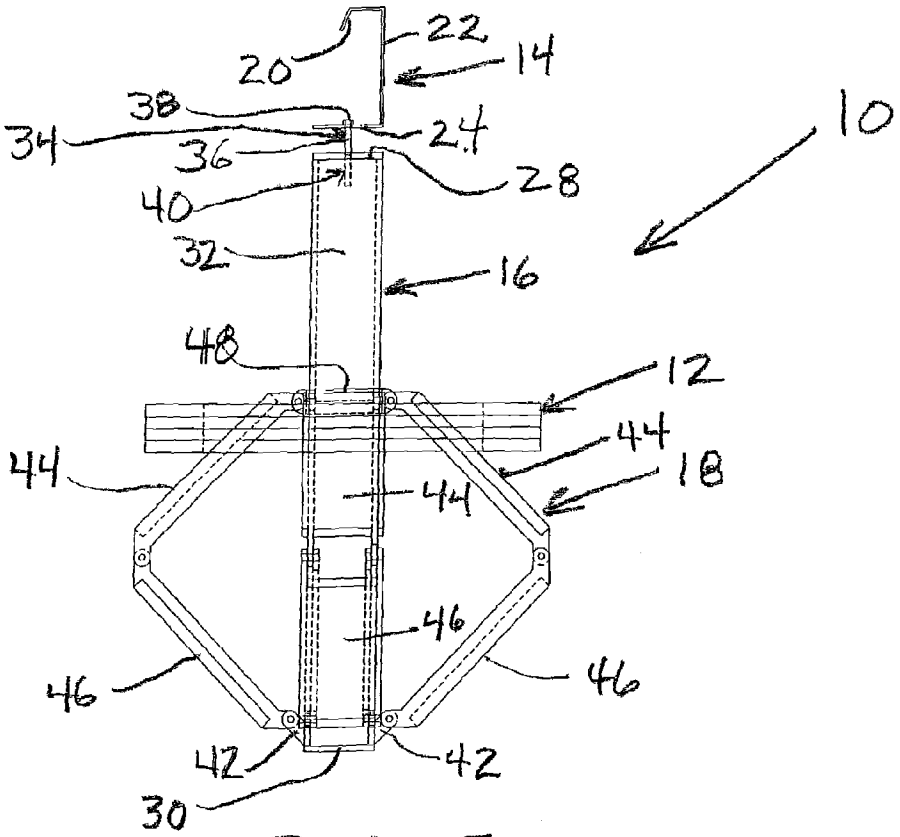
FIG. 5 is a view taken from the left side of FIG. 1.
Figure 6:
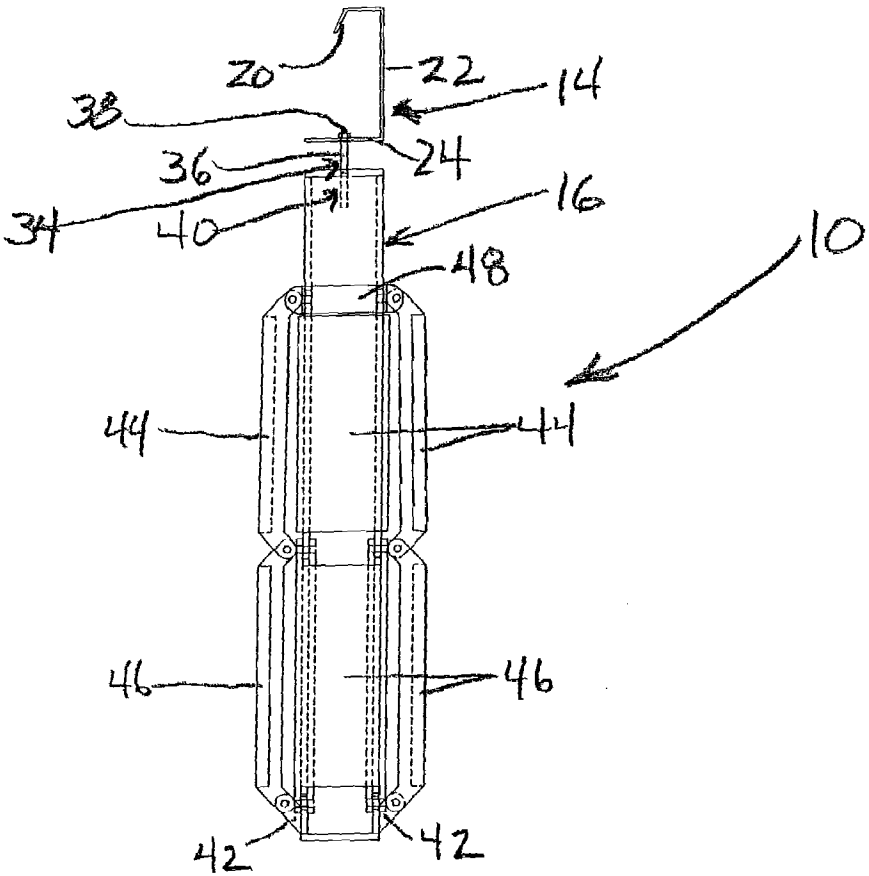
FIG. 6 is a view taken from the right side of FIG. 3.

As best seen in FIGS. 5 and 6, the top end 28 of the central member 16 is spaced from and rotatably connected to the lower horizontal wall 23 of support bracket 14 by a pivot pin 34. The pivot pin 34 has a shaft 36 which is passed through the aperture in wall 24 and movably retained thereon by an enlarged pinhead 38. A lower end 40 of the shaft 36 is secured, such as by screw threading, into the top end 28 and upper portion of the central member 16. The pivot pin 34 enables the central member 16 and support arm assemblies 18 to freely rotate about the vertical axis of the pin 34 and relative to the support bracket 14 which is fixedly engaged to support member 26. The bottom end 30 of the central member 16 is provided with a number of spaced apart pivot brackets 42. More specifically, the lower end of each sidewall 32 fixedly carries a pair of pivot brackets 42.

In the preferred embodiment, there are four hinged support arm assemblies 18, there being one for each central member sidewall 32. Generally, the number of support arm assemblies 18 is dependent on the configuration of the central member 16. Each support arm assembly 18 includes a planar upper support arm 44 and a planar lower support arm 46 which are typically identical in shape and size, and are preferably formed from plastic or other suitable rigid material.

Each upper support arm 44 has an upper end which is pivotally attached, such as by pins, to a guide collar 48 that is slidably mounted for vertical movement along the periphery of sidewalls 32 of the central member 16. Each upper support arm 44 has a lower end that is pivotally connected, such as by pins, to an upper end of each lower support arm 46. Each lower support arm 46 has a lower end that is pivotally coupled, such as by pins, to the pivot brackets 42 at the bottom of each central member sidewall 32.

Figure 3:
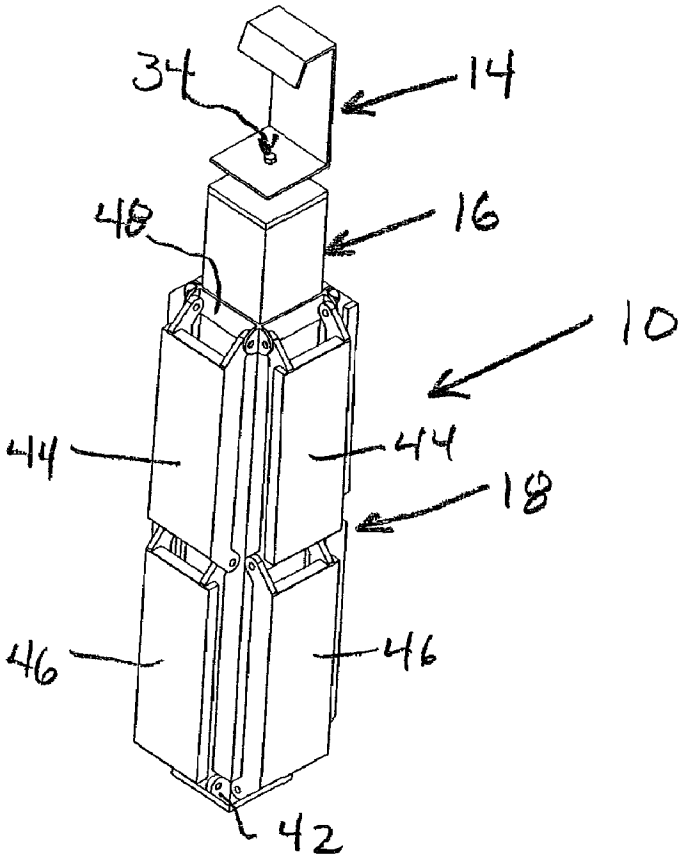
FIG. 3 is a perspective view of the dispensing apparatus in a retracted, material loading or storage position.
Figure 4:
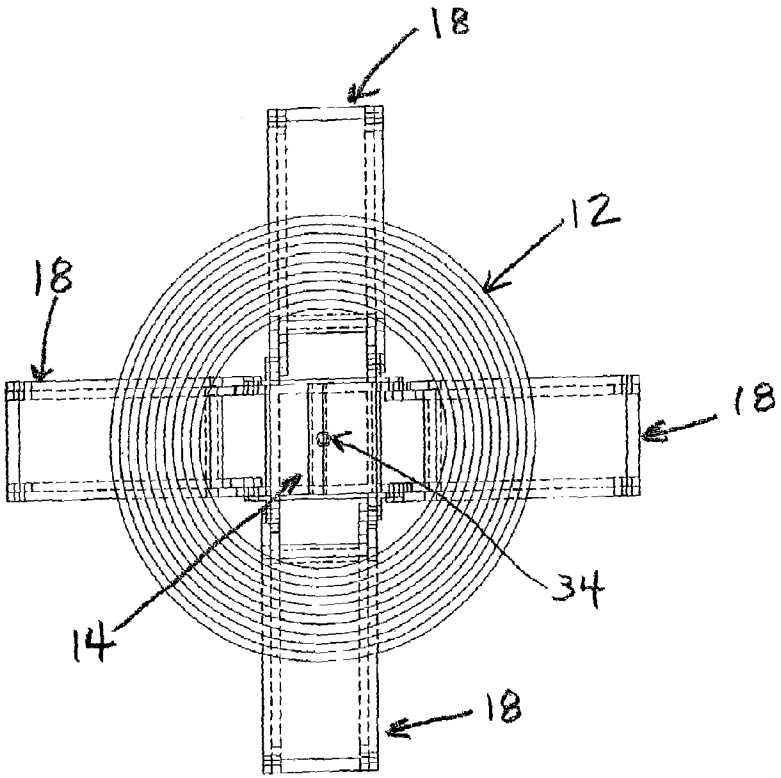
FIG. 4 is a top view of FIG. 1.

In use, the dispenser 10 is movable between a retracted position, as shown in FIGS. 3 and 6, and an extended position, as illustrated in FIGS. 1, 2, 4 and 5. In the retracted position, each pair of upper and lower support arms 44, 46 have outer surfaces that lie substantially coplanar with each other after guide collar 48 slides upwardly on central member 16 as each hinged support assembly 18 is held collapsed against a respective sidewall 32 of the central member 16. When the support assemblies 18 are released, the guide collar 48 will slide downwardly along central member 16 and each hinged support assembly 18 will buckle outwardly automatically due to gravity into the extended, material supporting position.

Then, electrical wire 12 in a roll having a central recess is placed over the support bracket 14 and the central member 16, and supported on the upper portion of each upper support arm 44 as best seen in FIGS. 1 and 5. The dispenser 10 with the roll of wire or other elongated flexible material 12 supported thereon is then suspended by means of the support bracket 14 from support member 26 as shown in FIG. 2. The electrician may then grasp and pull the end of the wire 12 from the dispenser 10. This causes the wire 12 to unwind as the hinged support assemblies 18 and the central member 16 freely rotate relative to the fixed support bracket 14 and the support member 26. When the electrician stops pulling the wire 12, the lower portion of the dispenser 10 beneath the support bracket 14 will stop rotating.

When the existing roll of wire is completely dispensed, a new roll can be placed on the dispenser 10 without removing it from the suspended position. This is done by placing the new roll at the bottom of the dispenser 10 and moving it upwardly which causes the support arms 44, 46 to retract. Once the new roll passes beyond the pivot point between the arms 44, 46, the arms 44, 46 will expand due to gravity causing again a supporting spot for the roll of wire 12.

The present invention thus provides an apparatus and method for supporting and dispensing an elongated flexible coiled material such as electrical wire, in a smooth, manageable fashion. The apparatus provides for a quick and convenient loading of a new material supply while hung in a suspended position. The dispenser is virtually maintenance free and requires no assembly and disassembly in use.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A dispenser used in unwinding a roll of elongated flexible material comprising:

a support bracket;

a central member rotatably mounted to the support bracket; and a plurality of hinged support arm assemblies attached to the central member and movable between an extended position and a retracted position, wherein the central member is an elongated, vertically extending element having a top end pivotally connected to the support bracket by a pin, and a bottom end provided with a series of pivot brackets fixed thereto, and wherein each hinged support arm assembly includes an upper support arm and a lower support arm, the upper support arm having an upper end pivotally attached to a guide collar that is slidably mounted along a periphery of the central member, and a lower end that is pivotally connected to an upper end of the lower support arm, the lower support arm having a lower end pivotally secured to the pivot brackets fixed on the bottom end of the central member.

2. The dispenser of claim 1, wherein the support bracket is a rigid member having a generally C-shaped cross section adapted to be supported from a support member.

3. A dispenser for unwinding a roll of flexible material comprising:

a rigid support bracket configured with a generally C-shape and formed with an upper hook portion, a vertical wall and a lower wall with an aperture provided therethrough;

a rigid, vertically extending central member in the form of an elongated bar with a generally polygonal cross section having flat side walls, a top end rotatably connected to the lower wall of the support bracket by a pivot pin, and a bottom end provided with a series of pivot brackets attached thereto; and a plurality of hinged support arm assemblies attached to the central member and movable between a retracted position and an extended position, each support arm assembly including an upper support arm and a lower support arm, the upper support arm having an upper end pivotally attached to a guide collar that is slidably mounted about a periphery of the central member, and a lower end that is pivotally connected to an upper end of the lower support arm, the lower support arm having a lower end pivotally secured to the pivot brackets fixed on the bottom end of the central member.

4. The dispenser of claim 3, wherein, in the retracted position, each pair of upper and lower support arms have outer surfaces that lie substantially coplanar with each other as each support arm assembly is held collapsed against a side wall of the central member.

5. The dispenser of claim 3, wherein in the extended position, each pair of upper and lower support arms buckle outwardly relative to the central member for supporting the roll of flexible material from the upper support arms.

6. The dispenser of claim 3, wherein the support bracket is engageable with a support member, and the central member and the hinged support arm assemblies are rotatable relative to the support bracket.

7. A method of dispensing flexible elongated material from a roll having a central recess, the method comprising the steps of:

(a) providing a dispenser including a rigid support bracket configured with a generally C-shape and formed with an upper hook portion, a vertical wall and a lower wall with an aperture provided therethrough, a rigid, vertically extending central member in the form of an elongated bar with a generally polygonal cross section having flat side walls, a top end rotatably connected to the lower wall of the support bracket by a pivot pin and a bottom end provided with a series of pivot brackets attached therethrough, and a plurality of hinged support arm assemblies attached to the central member and movable between a retracted position and an extended position, each support arm assembly including an upper support arm and a lower support arm, the upper support arm having an upper end pivotally attached to a guide collar that is slidably mounted about a periphery of the central member, and a lower end that is pivotally connected to an upper end of the lower support arm, the lower support arm having a lower end pivotally secured to the pivot brackets fixed on the bottom end of the central member, the hinged support arm assemblies buckling outwardly relative to the central member into an extended, material-supporting position;

(b) placing the recess of the roll of flexible material over the central member and the support bracket so that the roll of the flexible material is supported on upper portions of the extended upper support arms;

(c) suspending the support bracket from a fixed support member; and (d) pulling an end of the roll of flexible material so that the roll rotates with the hinge support arm assemblies and the central member relative to the fixed support member to unwind the flexible material from the roll.

8. The method of claim 7, wherein following exhaustion of the roll of flexible material, a new roll of flexible material is placed at the bottom of the dispenser and moved upwardly causing the upper and lower support arms to retract until the new roll passes beyond pivot points between the upper and lower support arms after which the upper and lower support arms extend so that the new roll is supported from the upper portions of the upper arms.

* * * * *